US007141108B2

(12) United States Patent
Eden et al.

(10) Patent No.: US 7,141,108 B2
(45) Date of Patent: Nov. 28, 2006

(54) METHOD FOR TREATING NON-WOVEN WEBS

(75) Inventors: James L. Eden, East Millstone, NJ (US); Mark A. Cole, Flemington, NJ (US); Remo Santacecilia, Wilmington, DE (US)

(73) Assignee: National Starch and Chemical Investment Holding Corp., New Castle, DE (US)

( * ) Notice: Subject to any disclaimer, the term of this patent is extended or adjusted under 35 U.S.C. 154(b) by 0 days.

(21) Appl. No.: 11/222,102

(22) Filed: Sep. 8, 2005

(65) Prior Publication Data

US 2006/0029739 A1 Feb. 9, 2006

Related U.S. Application Data

(62) Division of application No. 10/219,548, filed on Aug. 15, 2002, now Pat. No. 6,989,339.

(51) Int. Cl.

| | |
|---|---|
| ***C09D 103/02*** | (2006.01) |
| ***C09D 103/06*** | (2006.01) |
| ***C09D 103/04*** | (2006.01) |
| ***C09D 191/00*** | (2006.01) |
| ***C09D 191/06*** | (2006.01) |
| ***D21H 19/12*** | (2006.01) |
| ***A61L 15/34*** | (2006.01) |
| ***A61L 15/50*** | (2006.01) |

(52) U.S. Cl. ..... 106/206.1; 106/205.01; 106/205.8; 106/207.1; 106/216.1; 427/2.3; 442/97; 442/100; 442/102; 442/121; 162/135

(58) Field of Classification Search ..... 106/205.8, 106/205.01, 206.1, 207.1, 216.1; 427/2.3; 442/97, 100, 102, 121; 162/135
See application file for complete search history.

(56) References Cited

U.S. PATENT DOCUMENTS

| | | | | |
|---|---|---|---|---|
| 4,859,509 | A * | 8/1989 | Hasuly et al. | 427/442 |
| 2002/0051882 | A1* | 5/2002 | Lawton et al. | 428/378 |
| 2005/0158369 | A1* | 7/2005 | Dorschner et al. | 424/443 |

* cited by examiner

*Primary Examiner*—David M. Brunsman
(74) *Attorney, Agent, or Firm*—David LeCroy

(57) ABSTRACT

The present invention describes a means for fixing skin care ingredients on the surface of non-woven webs and cellulosic mats. The active ingredients can be released (deposited) onto the skin by normal triggering mechanisms, which include the action of water or urine or by friction or rubbing. The fixative systems described herein provide the ability to control high load levels while not interfering with the wettabliity of the fabric or paper. Additionally, incompatible/reactive ingredients can be treated onto the same web and are kept as separate particles fixed to the surface until released.

8 Claims, No Drawings

METHOD FOR TREATING NON-WOVEN WEBS

This application is a Division of 10/219,548, filed 15 Aug. 2002, now U.S. Pat. No. 6,989,339.

FIELD OF THE INVENTION

This invention relates to the method of preparation of a nonwoven web treated with emulsified oily mobile materials at or near the web surface and the corresponding treated web compositions. During application of the emulsion to the web, and subsequent drying, the oily mobile material is fixed in position. Release of the oily mobile material to the skin can be triggered by action of such things as heat, friction or moisture. Preparations described herein will find utility in many personal care items (e.g. diapers, sanitary wipes, etc.) where the controlled deposition of the oily mobile material onto the skin will be beneficial.

BACKROUND OF THE INVENTION

Nonwoven articles are found in every aspect of modern life, from diapers and adult incontinence devices to personal care items and bathroom tissue to baby wipes. Most if not all of these items come in contact with human skin during the normal course of their use.

It is a constant struggle to make these items softer, silkier and more pleasant to use without diminishing the absorptivity of the nonwoven web and thus not interfere with the intended utility of the article. One such invention, U.S. Pat. No. 5,607,760 (Donald Roe), relates to a lotion coated onto the topsheet of the disposable diaper or similar device. The lotion is transferred to the wearer's skin and thus reduces the adherence of bowel movements, while affording the wearer enhanced skin softness. One challenge of such an invention is to maintain the lotion at or near the surface of the web where it will be available for deposition onto the skin.

Generally lotions or emollients used in the treatment of skin are highly mobile, oil-like materials capable of easily migrating through a web. Migration of the lotion or oil can have a number of detrimental effects in that it will no longer be available for deposition or may adversely affect the absorption/transmittance of moisture (e.g. urine) into or through the supporting web and/or interferes with adhesion of converting adhesives. To overcome the migration problem U.S. Pat. No. 5,525,345 (Warner et al.) relies on a semi-solid lotion capable of melting at or around body temperature. Described in this reference are the use of synthetic type waxes and low molecular weight ethoxylates to afford the semi-solid consistency of the formulation. The semi-solid state will prevent the lotion from migrating until warmed to body temperature when it will liquefy and be deposited onto the skin.

In the above patents the inventors have touched upon the detrimental effects of having high loadings (the amount of lotion or emollient applied to the web) in the loss of tensile strength and reduction in caliper of the sheet. Typically in the industry thickness is correlated to softness and absorptivity.

Thus, there is still a long felt need in the marketplace for a treated web with high loadings of liquid or semi-solid lotions or emollients with good softness and feel while not interfering with water penetration/absorption or change in the thickness of the article. Ideally these emollient-treated webs may be undetectable to the casual user (unless intentionally made to stand out), but capable of delivering the lotion to the skin by action of an aqueous medium (e.g. urine or water) or other triggered release mechanisms such as friction.

SUMMARY OF THE INVENTION

It has now been found that selected starches can be used to fix high loading of liquid and semi-solid mobile materials including emollients, surfactants and skin care lotions to a non-woven web. The mobile materials can be deposited onto the skin by the action of a trigger (e.g. water or friction) and will afford minimal interference with the feel or adsorbtivity of the web. The process by which the starch/mobile material formulation is applied to the sheet may control the positioning of the ingredients on the web (e.g. surface or interior). The formulation may also be applied to specific areas of the web (e.g. the center or in stripes) so as not to interfere with adhesion or other physical attributes.

DETAILED DESCRIPTION OF THE INVENTION

For purposes of this application, a nonwoven web is any article or sheet-like form made from natural or synthetic fibers, in which the fibers are aligned in a random or semi-random order (not deliberately ordered). One skilled in the art would recognize the formation of some order during the web forming process (primarily in the machine direction), but this is completely different from the ordering obtained from traditional weaving or knitting processes. Examples of suitable fibers would be, but not limited to, cellulose, modified cellulose (cellulose acetate), polyesters, rayon, cotton, polyacrylonitrile (PAN), polylactic acid (PLA), polycaprolactone (PCL), polyolefins and bi-component fiber comprising two or more fiber-forming polymers such as polypropylene and polyethyleneterephthalate and the like.

The manufacturing process for making nonwoven webs is well known in the art by processes such as wet-laid, spunbond, meltblown, air-laid (dry laid) spunlace and needle punch. Included in our definition of non-woven webs suitable for use with this invention are porous films prepared by the action of chemical or mechanical processing (e.g. apertured films). Also included as useful for the purpose of this invention are paper and paper products.

The term "paper," as used herein, includes sheet-like masses and molded products made from fibrous cellulosic material, which may be derived from natural sources, synthetics such as polyamides, polyesters, rayon and polyacrylic resins as well as from mineral fibers such as asbestos and glass. In addition, paper made from combinations of cellulosic and synthetic materials are applicable herein.

Papermaking is a process of introducing an aqueous slurry of pulp or wood cellulosic fibers onto a screen or similar device in such a manner that the water is removed, thereby forming a sheet of the consolidated fibers, which, upon pressing and drying, can be processed into dry roll or sheet form.

The present invention will find utility with any weight of non-woven web and will depend greatly on the requirements of the particular application. Particularly suitable webs will have a basis weight (the weight of the web before any coating or treatments are applied) of less than about 100 grams per square meter (gsm), most suitable will be those having a basis weight of less than about 20 gsm.

The term emollient as used herein, refers to the semi-solid or liquid material used to provide a moisturizing, soothing feeling to the skin. Typically, emollients suitable for this invention can be soluble or insoluble in water, but must be non-volatile under condition of application and use to ensure a durable effect.

Examples of commercially available classes of emollients are, without limitation, hydrocarbon oils and waxes, acetoglyceride esters, silicone oils, ethoxylated glycerides, triglyceride esters, alkyl and alkenyl esters, fatty acids and alcohols and their esters and ethers, lanolin and it's derivatives, waxes derived from natural or synthetic sources, phospholipids and polyhydric alcohol esters. Some common examples are Aloe Vera, petrolatum, mineral oil, essential oils, hydroxy fatty acids, mono-, di- and tri-glycerides, esters and amides of fatty acids and the like. Particularly suitable emollients are mineral oil, petrolatum, vegetable oil, paraffin oil, and silicone oils.

Optionally, the emollient may contain a functional amount of surfactant. As used herein, surfactant refers to liquid, semi-solid or solid products used to provide compatibility between the finish and coating component in the formulation. Surfactants may also provide emulsification of the emollient and modify the hydrophobic properties of the fibrous substrate by allowing rapid transport of aqueous liquids. Classes of surfactants useful for this invention are listed below. The mixture of emollient and surfactant is typically referred to as the finish and generally will contain from about 5 to about 90% of the emollient with the remainder being one or more surfactants.

The oily mobile material of this invention may also primarily comprise a surfactant. Non-limiting examples of types of surfactants suitable for use in the present invention are sulphonates of alkanes and alkenes, salts of long chain fatty acids, ethoxylates of amines, alcohols, polyols and acids, alkoxylates, fatty acid esters, phosphate and sulfonate esters, sulphosuccinates and sulphosuccinamates, aryl sulphonates, castor oil ethoxylates, glycosides, protein derivatives and various block co-polymers.

The oily mobile material treated onto the web may also be a mixture of materials. Since the oil material is fixed as a discrete particle it is possible for two (or more) incompatible or reactive materials to be fixed to the web using this invention. Incompatible or reactive materials can be applied simultaneously or sequentially as separate emulsions. The materials are not in contact with each other even though they are fixed on the same web, and can be made to interact by the action of the triggering mechanism.

Typically the finish is prepared by heating the solid components until all have melted and stirring until the mixture is homogenous, then cooled with continuous stirring. The finish can be added to the fixative portion of the coating composition while hot or after cooling and either in undiluted form or as a dilution usually in water.

Typical sources for the starches and flours are cereals, tubers, roots, legumes and fruits. The native source can be corn, pea, potato, sweet potato, banana, barley, wheat, rice, sago, amaranth, tapioca, arrowroot, oat, canna, sorghum, and waxy or high amylose varieties thereof. As used herein, the term "waxy" is intended to include a starch or flour containing at least about 95% by weight amylopectin and the term "high amylose" is intended to include a starch or flour containing at least about 40% by weight amylose. While any starch can be useful in the practice of this invention, preferred base starches are those derived from corn, tapioca, sago and potato and most suitable are the waxy versions of these starches The starches embodied in this invention may be granular or pregelatinized. The term "granular starch" is intended to mean any starch (including chemically modified) that is in the same physical form as found in nature (e.g. not swollen or gelatinized). Pregelatinized starches are those starches, which have been treated to destroy the granular structure (e.g. birefringence), and will now swell or disperse in cold water (CWS).

Also suitable are the conversion products (where the molecular weight of the base starch has been reduced) derived from any of the former starch bases including, for example, dextrins prepared by hydrolytic action of acid and/or heat; oxidized starches prepared by treatment with oxidants such as sodium hypochlorite or hydrogen peroxide; and fluidity or thin boiling starches prepared by enzyme conversion or mild acid hydrolysis.

The method of application will generally determine the actual requirements for the starch fixative. We have found that suitable starches will have been converted (reduced molecular weight) to a water fluidity (wf) of at least 40 (the higher the number the lower the molecular weight and thus the lower the viscosity). Most suitable will be starches converted to a water fluidity greater than about 70, maltodextrins or pyrodextrins. The measurement for "water fluidity" (WF) as described herein is made using a Thomas Rotational Shear-Type Viscometer (manufactured by Arthur H. Thomas Co., Philadelphia, Pa.) in accordance with standard procedures such as disclosed in Zwiercan et al., U.S. Pat. No. 4,499,116 issued Feb. 12, 1985, which patent is incorporated by reference herein. A further detailed description of this measurement is presented later in the examples section.

Pyrodextrins are defined as the hydrolysis product of starch treated at high temperature and low moisture content. Maltodextrins are a purified, concentrated, non-sweet nutritive mixture of saccharide polymers obtained by the partial hydrolysis of edible starch (Food Chemicals Codex, IV edition, page 239). Maltodextrins are generally low molecular weight versions of the base starch; whereas, pyrodextrins have undergone some level of molecular rearrangement. The viscosity of dextrins are typically measured in ABF units. The ABF value (anhydrous borax fluidity) is defined as the ratio of the amount of water to the amount of anhydrous dextrin when the latter is cooked for 5 minutes at 90° C. with 15% borax (on the weight of the dextrin), so as to provide a dispersion having a viscosity, when cooled to 25° C., of 70 mPa.s. (see U.S. Pat. No. 3,445,838 issued Dec. 1, 1964 to R. B. Evans et al., incorporated by reference herein).

The method of applying the formulation (fixative+load) to the web will dictate the upper limit on viscosity, but will vary with parameters such as run speed, application amount and application temperature. One skilled in the art will recognize that excessively high viscosities (e.g. greater than 1,000 mPa.s) will require special provisions beyond what is typically used in commercial manufacture.

The selected starch component, which can be used in the fixative formulations of this invention, may be unmodified (native) or chemically modified starches and more particularly are starch esters and starch ethers. The starch esters and starch ethers may contain nonionic or ionic groups such as cationic, e.g. tertiary amine and quaternary ammonium groups, or anionic groups, and may be crosslinked. The most suitable modifications are organic acid anhydrides, alkylene oxides, and oxidizing reagents, more particularly octenylsuccinic anhydride (OSA), propylene oxide (PO) and sodium hypochloride. Modified starches of these types, and methods for making them, are described in "Starch: Chemistry and Technology", edited by R. L. Whistler et al, Chapter X, 1984.

One modification of starch that is especially useful in this invention is a starch ester prepared from an organic acid anhydride having a hydrophobic group such as octenyl or dodecenyl succinic anhydride. More particularly, the hydrophobic group is a hydrocarbon group such as alkyl, alkenyl, aralkyl or aralkenyl having 2 to 22 carbons, preferably 5 to 18 and most particularly 8 to 12 carbons. Generally the starch will be treated with up to about 60%, more particularly from about 1 to about 60% and most particularly from about 3 to about 10% by weight of the anhydride, based on the weight of starch. A detailed description of the synthesis can be found in U.S. Pat. No. 2,661,349 (1953) to Caldwell et. al. and U.S. Pat. No. 5,672,699 (1997) to Billmers et. al. which are hereby incorporated by reference.

The term active, as used herein, is defined as being an oily mobile material (e.g. emollient or surfactant, such as those listed above). Non-limiting examples of suitable surfactants are sorbitan esters, long chain fatty alcohols (e.g. cetyl alcohol) and ethoxylates of fatty acid esters or alcohols (e.g. Span®60, Tween®80, Brij® 52, etc.). Non-limiting examples of emollients are mineral oil, petrolatum, vegetable oil, paraffin oil, and silicone oils. The active may also be a blend of one or more emollients or surfactants. The active may also contain additional ingredients dissolved or suspended in the oily material, for example antioxidants, vitamins including vitamin E, medications, and the like.

The amount of active material and other components in the load, which makes up the formulation, can vary. Load is defined as the total amount of all ingredients except the fixative (starch) in the formulation including active material, surfactant, emollient and optional other additive ingredients in the formulation. The formulation will comprise, on a dry basis, from about 15 to 90% by weight of load and from about 85 to 10% by weight of starch, more suitably from about 30 to 85% by weight of load and from about 15 to 70% by weight of starch, and most suitably from about 50 to 85% by weight of load and about 15 to 50% by weight of starch. The percent (%) load is the anhydrous (dry) weight of the load divided by the anhydrous (dry) weight of the total formulation (e.g. load plus starch)×100. The load may comprise from about 10 to 100% by weight of active and from about 0 to 90% of other additive ingredients.

Depending on use, the total amount of formulation (load plus fixative) applied to the web will vary greatly with the desired result. Typically the total anhydrous formulation applied to the web will range from about 0.5% to about 50% based on the weight of the web (dry basis).

Preparation of the starch fixative formulation can be accomplished by cooking the starch at the desired solids and then emulsifying the active into the starch cook. Alternatively the formulation may be prepared by co-cooking the starch with the active with sufficient shear to form the emulsion.

In addition, the formulation may contain other additive ingredients normally found in such systems. Some non-limiting examples of these other ingredients would be fragrances, colorants, fillers, essential oils, vitamins, antibiotics, and the like. While it is typical in today's industry to use synthetic polymers to aid in the fixative process, it is the purpose of this invention to be substantially free of fixative polymers other than the presently disclosed starch fixatives, such other fixative polymers including without limitation synthetic fixatives, natural and synthetic waxes, and other low molecular weight polymers.

The term "fixed" is taken to mean the method or process by which the mobile emollient is held in place in or on the web. The active can be fixed at the surface of the web, internally or both, depending on the specifics of the application.

One skilled in the art would recognize the utility of this invention in applications such as diapers, feminine napkins, skin care wipes, facial and bath tissue, adult incontinence products such as protective underwear, underpads, bladder control beds, and the like. While skin care is the obvious application of the described invention, many other industrial applications may find utility. Some non-limiting examples are anti-rust wrapping material, fragrance release papers and household or industrial cleaning, polishing, lubricating, sanitizing and absorbent cloths or papers.

EXAMPLES

The following examples are presented to further illustrate and explain the present invention and should not be taken as limiting in any regard. Unless stated otherwise, all percents are in a weight/weight basis.

Water Fluidity Measurement

The water fluidity of the starches is measured using a Thomas Rotational Shear-Type Viscometer (manufactured by Arthur H. Thomas Co., Philadelphia, Pa. 19106), standardized at 30° C. with a standard oil having a viscosity of 24.73 mPa.s., which oil requires 23.12. ±0.05 sec. for 100 revolutions. Accurate and reproducible measurements of the water fluidity are obtained by determining the time which elapses for 100 revolutions at different solids levels depending on the starch's degree of conversion (as conversion increases, the Water Fluidity increases and the viscosity decreases). The procedure used involves slurrying the required amount of starch (e.g., 6.16 g, dry basis) in 100 ml of distilled water in a covered copper cup and heating the slurry in a boiling water bath for 30 minutes with occasional stirring. The starch dispersion is then brought to the final weight (e.g., 107 g) with distilled water. The time required for 100 revolutions of the resultant dispersion at 81°–83° C. is recorded and converted to a water fluidity number using a conversion table.

| Time Required for 100 Revolutions (seconds) Amount of Starch Used (anhydrous, g): Water | | | | |
|---|---|---|---|---|
| 6.16[a] | 8.80[b] | 11.44[c] | 13.20[d] | Fluidity |
| 60.0 | | | | 5 |
| 39.6 | | | | 10 |
| 29.3 | | | | 15 |
| 22.6 | | | | 20 |
| 20.2 | | | | 25 |
| | 33.4 | | | 30 |
| | 27.4 | | | 35 |
| | 22.5 | | | 40 |
| | | 32.5 | | 45 |
| | | 26.8 | | 50 |
| | | 22.0 | | 55 |
| | | | 24.2 | 60 |
| | | | 19.2 | 65 |
| | | | 15.9 | 70 |
| | | | 13.5 | 75 |
| | | | 11.5 | 80 |
| | | | 10.0 | 85 |
| | | | 9.0 | 90 |

For [a], [b], [c], and [d], final weights of starch solutions are 107, 110, 113, and 115 g, respectively.

Example 1

Dextrin Fixative for Water Insoluble Emollient and Fragrance

This shows the production of an emollient emulsion, the spray application of that emulsion on a web and the utility of that treated web.

A pyrodextrin with an ABF of about 4 produced from tapioca starch that had been treated with about 3% octenyl succinic anhydride was slurried in water and cooked by direct steam injection in a model C-1 jetcooker (National Starch and Chemical Co., Bridgewater, N.J.) to produce a dextrin dispersion at about 45 percent anhydrous solids. About 300 ml of this dispersion, at 49° C. (120° F.), was placed in a one liter 316 stainless steel beaker and mixed with a Silverson model L4RT laboratory emulsifier (Silverson Machines, E. Longmeadow, Miss.) fitted with a 31.75 mm (1.25 inch) diameter fine screen emulsifying head. The mixer speed was set at 10,000 rpm. Sufficient Dow Corning 245 silicone oil (Dow Corning, Midland Mich.) was slowly added, over a five minute period, to give an anhydrous ratio of 45 parts dextrin and 25 parts Dow Corning oil. Aloe Vera extract (Verogel 1:1, Dr. Madis Laboratories, South Hackensack, N.J.) was added to the dispersion with mixing in an amount sufficient to give an anhydrous ratio of 45 parts dextrin, 25 parts silicone oil and 25 parts aloe extract. Peppermint oil (redistilled peppermint oil FFC obtained from Ungerer Co. Lincoln Park, N.J.) was added to the dispersion with mixing in an amount sufficient to give an anhydrous ratio of 45 parts dextrin, 25 parts silicone oil, 25 parts aloe extract and 5 parts peppermint oil. This was diluted with warm water to about 20% solids.

This dispersion (designated A in Table 1, below) was applied to a 30.48 cm (12 inch) by 40.64 cm (16 inch) portion of polypropylene lightweight diaper topsheet (spunbond/melt blown/spunbond SMS by PGI, Mooresville, N.C.). The web was placed on a screen on the top of a spray box fitted with air exhaust fans and air drawn through at low velocity to control overspray. The dispersion was sprayed onto the web using a Schlick model 970/4 with 0.5 mm liquid insert (available from Orthos Liquid Systems, Bluffton, S.C.) air atomizing nozzle with an air pressure of about 1.05 kg/cm$^2$ (15 psig). The dispersion was pumped to the nozzle through a Masterflex peristaltic pump (Cole Parmer) at about 10 ml per minute. The nozzle, mounted on a wand, was moved over the web, at a distance of about 25.4 cm (10 inches), to apply a uniform treatment to the web. The web was dried in a forced air oven for 1 minute at 65° C. (150° F.), weighed and the dry treatment weight recorded.

The resulting webs were little changed in appearance compared to the starting material. Close or microscopic examination showed the treatment to be present as dried particles fixed on the fibers of the web. The particles were bound to the web and not dislodged by folding, stacking or storage of the web. The web had little or no odor. Vigorous rubbing of the web treated surface or between two other sheets ruptured the particles and released the fixed additives as detected by the oily feel on the fingers or to sudden odor of the peppermint. Water applied to the treated web dissolved the particles and released the fixed additives.

Example 2

Visual Determination of Fixative Location of Non-Woven Web

A dextrin dispersion was made using the process described in example 1. Sufficient Dow Corning 245 silicone oil (Dow Corning, Midland Mich.) was slowly added, over a five minute period, to give an anhydrous ratio of 45 parts dextrin and 45 parts Dow Corning oil. Sufficient citric acid (ACS reagent grade, Aldrich Chemical Co, Milwaukee Wis.) was added (as a 35% solids water solution) to give a ratio of anhydrous components of 45 parts dextrin, 45 parts Dow Corning 245 oil and 10 parts citric acid. Warm water was added to adjust the total solids to about 20%. Red food color dye was added to give a red color to the dispersion for easy visual determination when apply to the web. This is sample B (in Table 1 below) and was sprayed as in example 1.

The resulting webs were pink. Microscopic examination showed the treatment to be present as red dried particles fixed on the fibers of the web. The particles were bound to the web and not dislodged by folding, stacking or storage of the web. Vigorous rubbing of the web treated surface or between two other sheets ruptured the particles and released the fixed oil. Water applied to the treated web dissolved the particles and released the fixed oil and acid.

Example 3

Dextrin Fixative for Water Soluble Active Material

A dextrin dispersion was made as described in example 1. Aloe Vera extract (Verogel 1:1, Dr. Madis Laboratories, South Hackensack, N.J.) was added to the dispersion with mixing in an amount sufficient to give an anhydrous ratio of 70 parts dextrin, 30 parts aloe extract. Warm water was added to give a total solids of about 20%. Blue food color dye was added to give a blue color to the dispersion. This is sample C (in Table 1 below) and was sprayed onto the web as in described in example 1.

The resulting webs were blue. Microscopic examination showed the treatment to be present as blue dried particles fixed on the fibers of the web. The particles were bound to the web and not dislodged by folding, stacking or storage of the web. Vigorous rubbing of the web treated surface or between two other sheets ruptures the particles and releases the fixed aloe. Water applied to the treated web dissolves the particles and releases the fixed aloe.

Example 4

Fixative for Separate Incompatible Materials

Sample B+C (in Table 1 below) is a web treated with approximately equal volumes of dispersion B and dispersion C applied as two passes to the same web.

The resulting webs were purple to the naked eye. Microscopic examination showed the treatment to be present as separate blue and red particles fixed on the fibers of the web. This shows the ability to separately fix potentially incompatible or reactive additives to the same web.

TABLE 1

| Polypropylene Treated Webs | | | | |
|---|---|---|---|---|
| Expt. # | Sample | Sheet Weight (untreated) | Sheet Weight (treated) | % Treatment (dry basis) |
| 1 | A | 1.92 g | 3.13 g | 38.6% |
| 2 | A | 1.92 g | 2.91 g | 34.0% |
| 3 | A | 1.92 g | 3.74 g | 48.6% |
| 4 | A | 1.92 g | 2.74 g | 30.2% |
| 5 | B | 1.92 g | 3.07 g | 37.5% |
| 6 | C | 1.92 g | 2.83 g | 32.2% |
| 7 | B + C | 1.92 g | 4.13 g | 53.5% |

The results in table 1 show the fixing of an emollient oil, a water-soluble extract and/or fragrance oil onto the surface of a non-woven web. The ingredients are held on the surface with no tendency to migrate into the sheet and can be released on contact with water or by mechanical energy (rubbing). These examples also demonstrated the ability to keep reactive/incompatible materials fixed on the fibers of the web, but separated until released.

Example 5

Dextrins for Emollient Fixation

This example shows the production of an emollient emulsion, the spray application of that emulsion on a web and the utility of that treated web.

A pyrodextrin with a ABF of about 4 produced from tapioca starch that had been treated with about 3% octenyl succinic anhydride was slurried in water and cooked by direct steam injection in a model C-1 jetcooker to produce a dextrin dispersion at about 30 percent anhydrous solids. About 3000 ml of this dispersion, at 65° C. (150° F.), was placed in a 7 liter 316 stainless steel beaker and mixed with a Silverson model L4RT laboratory emulsifier (Silverson Machines, E. Longmeadow, Miss.) fitted with a 31.75 mm (1.25 inch) diameter fine screen emulsifying head. The mixer speed was set at 10,000 rpm. Sufficient molten petrolatum (Sonojell 9 Witco Chemical Corp, Greenwich, Conn.) was slowly added, over a ten minute period, to give an anhydrous ratio of 20 parts dextrin and 80 parts petrolatum. After an additional 15 minutes of mixing the 50% weight median particle size diameter was about 1 micron. This was dyed pink with red food coloring dye and diluted with warm water to about 35% solids.

This dispersion was applied to a polypropylene lightweight diaper topsheet (spunbond/melt blown/spunbond, SMS by PGI, Mooresville, N.C.). A pilot scale continuous hotmelt laminator (Independent Machine Co) was modified to spray the emulsion. A 35.56 cm (14-inch) wide roll of web was mounted on the supply spindle; the web brought through the tension control rolls and horizontally across the converting section. A two fluid, air atomizing, flat fan spray nozzle (Spraying Systems, ¼ J setup SUN 13) was mounted above the web. Emulsion was supplied to the nozzle from an air-pressurized vessel, through tubing, at 2.1 kg/cm$^2$ (30 psig). Atomizing air was supplied to the nozzle at about 6.7 kg/cm$^2$ (35 psig). The nozzle was set to treat the central 20–25 cm (8–10 inches) of the web.

The web then passed under a warm air jet and was wound on the take-up roll. Web speed and feed pressure was varied to adjust the emulsion delivery rate to the web. This sample is labeled D and the results are shown in Table 2, below.

A pyrodextrin with a ABF of about 4 produced from tapioca starch that had been treated with about 3% octenyl succinic anhydride was slurried in water and cooked by direct steam injection in a model C-1 jetcooker to produce a dextrin dispersion at about 30 percent anhydrous solids. About 3000 ml of this dispersion, at 65° C. (150° F.), was placed in a 7 liter 316 stainless steel beaker and mixed with a Silverson model L4RT laboratory emulsifier (Silverson Machines, E. Longmeadow, Miss.) fitted with a 31.75 mm (1.25 inch) diameter fine screen emulsifying head. The mixer speed was set at 10,000 rpm. Sufficient molten petrolatum/surfactant mixture was slowly added, over a ten minute to give a dry ratio of 30 parts starch and 70 parts of load (57.1% Petrolatum USP Witco, 14.3% Brij 52, 21.5% Tween 20, 7.1% Span 80; all available from Uniqema, New Castle Del.). This was dyed blue with blue food coloring dye and diluted with warm water to about 35% solids. This formulation was applied to the web in the fashion described above. This sample is labeled E and the results are shown in table 2, below.

These treated webs and an untreated control were tested for synthetic urine wet through (European Disposables And Non-wovens Association) non-woven cover stock liquid strike-though time (simulated urine), EDANA test method 150.3-96) with the exception that Whatman #1 was used in place of Hollingsworth & Vose ERT FF3w/s filter paper. The time to penetrate the web is shown in Table 2 as strike through.

TABLE 2

Emollients fixed to a non-woven web with and without surfactant.

| Sample | Surfactant | Petrolatum pickup (%) | Petrolatum (g/M$^2$) | strike through (sec) |
|---|---|---|---|---|
| D | No | 18.9 | 2.895 | 136 |
| D | No | 7.7 | 1.184 | 124 |
| Control | No | 0 | 0 | 79 |
| E | Yes | 10.3 | 1.482 | 42 |
| E | Yes | 18.6 | 2.863 | 45 |

This example demonstrates the use of modified dextrins as a fixative for water insoluble emollients onto the surface of a non-woven web. The addition of surfactants to the fixative formulation allows the treated web to transport water (aqueous fluids) at rates similar to untreated sheets while maintaining a high loading of water insoluble emollients. The emollients are released by the action of the water or mechanical forces (rubbing) to be deposited onto the skin.

Example 6

Screening Evaluation for Various Starch Fixatives

The dextrin dispersions were prepared as described in example 1 and diluted to 20%. The cooked starches were then blended with Atphos® MBA 1310 and polyoxyethylene Lial 125 ($C_{12-15}$) alcohol at the specified anhydrous ratio and were blended with a Silverson model L4RT laboratory emulsifier (Silverson Machines, E. Longmeadow, Miss.) fitted with a 31.75 mm (1.25 inch) diameter fine screen emulsifying head for about 5 minutes. These mixtures were drawn on a glass plate as a 0.254 mm (0.01 inch) wet film and dried, at room temperature, for 24 hours.

TABLE 3 screening of various starches for emollient fixatives

| Starch | Formulation Solids | Starch/Emollient Ratio | Appearance | Evaluation |
|---|---|---|---|---|
| Waxy maize, wf = 40, 3% Octenylsuccinic anhydride | 10% solids | 1:1 | Acceptable Viscosity | Sep oily film |

TABLE 3-continued screening of various starches for emollient fixatives

| Starch | Formulation Solids | Starch/Emollient Ratio | Appearance | Evaluation |
|---|---|---|---|---|
| Waxy maize, wf = 70, 3% Octenylsuccinic anhydride | 20% | 1:1 | Acceptable Viscosity | No separation |
| Waxy maize, wf = 85, 3% Octenylsuccinic anhydride | 20% | 1:1 | Acceptable Viscosity | No separation |
| Waxy maize, wf = 40, 3% Octenylsuccinic anhydride | 10% solids | 2:3 | Acceptable Viscosity | Sep oily film |
| Waxy maize, wf = 70, 3% Octenylsuccinic anhydride | 20% | 2:3 | Acceptable Viscosity | Sep oily film |
| Waxy maize, wf = 85, 3% Octenylsuccinic anhydride | 20% | 2:3 | Acceptable Viscosity | Slight Sep |
| Waxy maize, cross-linked | 10% | 1:1 | Too thick | No separation |
| Potato | 10% | 1:1 | Too thick | Sep oily film |
| Canary corn dextrin, ABF = 2 | 20% | 1:1 | Acceptable Viscosity | No separation |
| Canary corn dextrin, ABF = 2 | 20% | 2:3 | Acceptable Viscosity | Sep oily film |

"Appearance" shows observations of the wet mixture at specified solids; too thick could not be readily sprayed or roll coated (typically greater than 1000 mPa.s). This demonstrated that a certain minimum level of conversion (hydrolysis of the base starch or reduction of the molecular weight) is desirable for most applications.

"Evaluation" shows observations of the dry films and predicts the ability of these mixtures to fix the emollient in a dry particle. Oil separation show the starch and surfactant are not compatible and will not be able to hold (fix) the emollient onto the surface of the web.

This example also shows that certain starches may be useful to fix the emollient while being too viscous to make application practical. Similarly, low viscosity starches may be suitable for application, but may not be acceptable for fixing, especially at the higher loadings.

Example 7

Dextrin Fixative Applied to a Paper Surface

A pyrodextrin with a ABF of about 4 produced from tapioca starch that has been treated with about 3% octenyl succinic anhydride is slurried in water and cooked by direct steam injection in a model C-1 jetcooker to produce a dextrin dispersion at about 45 percent anhydrous solids. About 300 ml of this dispersion, at 49° C. (120° F.), is placed in a one liter 316 stainless steel beaker and mixed with a Silverson model L4RT laboratory emulsifier fitted with a 31.75 mm (1.25 inch) diameter fine screen emulsifying head. The mixer speed is set at 10,000 rpm. Sufficient petrolatum is slowly added, over a five minute period, to give an anhydrous ratio of 25 parts dextrin to 75 parts Dow Corning oil. The formulation is diluted with warm water to about 20% solids.

This dispersion is applied to tissue paper of a basis weight of about 55 g/m$^2$. The web is then placed on a screen on top of a spray box fitted with air exhaust fans and air drawn through at low velocity to control overspray. The dispersion is sprayed onto the web using a Spraying Systems SS1/4J air atomizing nozzle with an air pressure of about 1.05 kg/cm$^2$ (15 psig). The dispersion is pumped to the nozzle through a Masterflex peristaltic pump at about 10 ml per minute. The nozzle, mounted on a wand, can be moved over the web, at a distance of about 25 cm (10 inches), to apply a uniform treatment to the web. The web is then dried in a forced air oven for 1 minute at 65° C. (150° F.).

The above example illustrates the utility of the invention for treating cellulosic webs (e.g. paper or fabric) with a fixed emollient system. The emollient will be held in place on the surface of the cellulose mat until released by water or friction and has utility in facial and bath type tissue.

What is claimed is:

1. A method for treating a non-woven web comprising the steps of:

dispersing one or more starches in water, wherein the one or more starches have been converted to a water fluidity of at least 40;

adding one or more oily mobile materials to said starch dispersion to form a mixture, and applying the mixture to a non-woven web.

2. The method of claim 1, wherein the one or more oily mobile materials is an emollient.

3. The method of claim 1, wherein the one or more starches is selected from the group consisting of waxy maize, tapioca, potato and sago.

4. The method of claim 3, wherein the one or more starches is at least a converted starch.

5. The method of claim 3, wherein the one or more starches is modified with octenyl succinic anhydride, propylene oxide or sodium hypochloride.

6. The method of claim 1, wherein the one or more oily mobile materials is selected from the group consisting of an emollient, a surfactant, and a blend of a surfactant and an emollient.

7. The method of claim 6, wherein the one or more starches is a pyrodextrin or maltodextrin.

8. The method of claim 7, wherein the pyrodextrin or maltodextrin is chemically modified with octenyl succinic anhydride and the one or more oily materials is petrolatum, the composition further comprising a surfactant.

* * * * *